United States Patent [19]

Orlando, Jr.

[11] Patent Number: 5,001,784

[45] Date of Patent: Mar. 26, 1991

[54] GARMENT

[76] Inventor: Charles J. Orlando, Jr., 128 Monmouth Blvd., Oceanport, N.J. 07757

[21] Appl. No.: 481,042

[22] Filed: Feb. 16, 1990

[51] Int. Cl.[5] ..... A41C 13/00; A41C 3/08

[52] U.S. Cl. ..... 2/114; 2/52; 2/88; 2/DIG. 7

[58] Field of Search ..... 2/46, 48, 49 R, 50, 2/51, 52, 75, 80, 88, 114, 105, 106

[56] References Cited

U.S. PATENT DOCUMENTS

| | | | |
|---|---|---|---|
| 1,497,685 | 6/1924 | Hoyme | 2/48 X |
| 2,504,534 | 4/1950 | Kephart et al. | 2/49 R |
| 2,520,026 | 8/1950 | Beitchman | 2/DIG. 7 |
| 3,464,063 | 9/1969 | Hoegerman | 2/114 |
| 3,665,518 | 5/1972 | Leadford | 2/49 R |
| 3,747,122 | 7/1973 | Goldberg | 2/48 |
| 3,868,728 | 3/1975 | Krzewinski | 2/114 |
| 4,570,268 | 2/1986 | Freeman | 2/114 |
| 4,622,699 | 11/1986 | Spriggs | 2/114 |
| 4,653,120 | 3/1987 | Leaf | 2/114 |
| 4,771,480 | 9/1988 | Stimson et al. | 2/DIG. 7 X |
| 4,837,863 | 6/1989 | Van Scoy-Mosher | 2/DIG. 7 X |

*Primary Examiner*—Werner H. Schroeder
*Assistant Examiner*—Jeanette E. Chapman
*Attorney, Agent, or Firm*—Ezra Sutton

[57] ABSTRACT

A hospital gown which has two sides openings and fold sections which fold inwardly to provide privacy when the garment is fastened or tied along the side openings.

13 Claims, 2 Drawing Sheets

GARMENT

FIELD OF THE INVENTION

The present invention relates to a novel garment with side openings, which may be used as a hospital gown and also has other applications.

BACKGROUND OF THE INVENTION

Conventional hospital gowns usually open in the front or back and have a number of drawbacks. They do not provide sufficient privacy and comfort to the patient and do not easily accommodate the connection to or removal from the patient of various medical tubes, leads, I.V. lines, catheters, etc., that a patient is subjected to. Conventional gowns cannot be changed while a patient is hooked up to the medical tubes, lines, etc., and it is difficult to examine a patient without removing the gown. Also, some conventional hospital gowns are not acceptable for X-ray, C.T. scan, or radiation therapy procedures.

U.S. Pat. No. 2,736,900 to Koren discloses a garment having a side opening, but it does not solve the foregoing drawbacks. U.S. Pat. No. 2,520,026 also discloses a side opening garment, but it does not provide the desired privacy.

Accordingly, it is an object of the present invention to provide an improved gown which is uncomplicated, fits well, is comfortable, provides privacy, is easy and inexpensive to manufacture, is easy to change, accommodates medical tubes and leads with a minimum of inconvenience to the patient, and is acceptable for X-ray, C.T. scan, and radiation therapy procedures. It is an all-purpose gown that would serve most, if not all, hospital applications, with "one size fitting most."

SUMMARY OF THE INVENTION

In accordance with the principles of the present invention, there is provided a garment formed from a single flat integral sheet of drapable material having a generally rectangular configuration and a central through opening for receiving a wearer's head. The sheet region on opposite sides of the opening defines shoulder sections and sleeve sections for covering the upper arms of the wearer, and the sheet region on opposite ends of the opening defines front and rear sections for covering, respectively, the front and back of the wearer. The sheet has substantially straight first and second longitudinal edges and first and second longitudinal tie lines remote from the first and second longitudinal edges, respectively. The area between the first longitudinal tie line and the first longitudinal edge defines a first fold section, and the area between the second longitudinal tie line and the second longitudinal edge defines a second fold section.

Three front ties are attached to each of the first and second longitudinal tie lines in the front section; and three rear ties are attached to each of the first and second longitudinal tie lines in the back section. The front ties on each side of the front section are adapted to be tied to the rear ties on each side of the rear section when the garment is draped over a wearer, so that the first and second fold sections are folded inwardly to close any openings between the ties for increased privacy of the wearer.

BRIEF DESCRIPTION OF THE DRAWINGS

Further objects, features, and advantages of the present invention will become apparent upon the consideration of the following detailed description of a presently-preferred embodiment when taken in conjunction with the accompanying drawings, wherein.

DETAILED DESCRIPTION OF THE PREFERRED EMBODIMENTS

Figure 4:
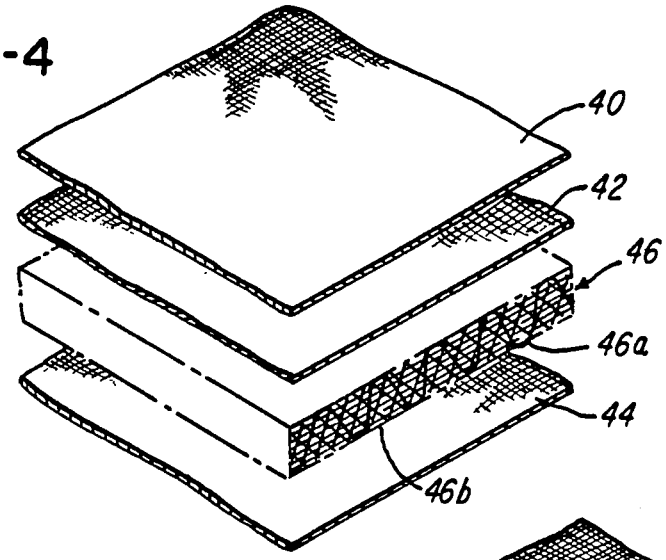
FIGS. 4 and 5 are cross-sectional views of one side of the garment.
Figure 5:
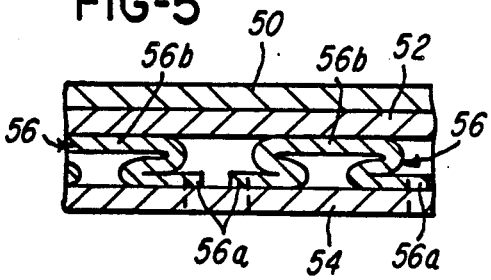

The present invention includes a flat integral sheet 10 of drapable material, such as cloth, paper, fabric Tyvek material, or the like. The sheet 10 is of rectangular configuration and preferably is made in a range of sizes from 30"×60" for children and small adults; 45"×90" for average to large-sized adults; and 60"×120" for very large or oversized adults or any measurement therein. The length to width ratio is approximately 2 to 1.

Sheet 10 includes a central through opening 12 for receiving a wearer's head, and the opening can be of any suitable shape and size, approximately 8" to 12" in diameter. The opening is equally spaced on either side of an imaginary shoulder line 13.

On one side of opening 12 is a shoulder section 14 and a sleeve section 16, while on the other side is a shoulder section 18 and a sleeve section 20. As will be explained, shoulder sections 14 and 18 are for draping over the wearer's shoulders, and sleeve sections 16 and 20 form sleeve areas to cover the upper arms of the wearer.

On one end of opening 12 is a front section 22 for covering the front of the wearer and a rear section 24 for covering the back of the wearer.

Sheet 10 has substantially straight front longitudinal edges 26 and 28 in the front section 22 and substantially straight rear longitudinal edges 30 and 32 in the rear section 24.

Sheet 10 includes front longitudinal tie lines 34 and 36 and rear longitudinal tie lines 38 and 40. The area between front longitudinal tie lines 34 and 36 and front longitudinal edges 26 and 28, respectively, defines front fold sections 42 and 44, and the area between rear longitudinal tie lines 38 and 40 and rear longitudinal edges 30 and 32, respectively, defines rear fold sections 46 and 48. The longitudinal tie lines are spaced from their respective longitudinal edges between 2½" to 5" more or less, for a purpose to be explained.

Front tie line 34 has three front ties 50 attached to it, and front tie line 36 has three front ties 52 attached to it. Similarly, rear tie line 38 has three rear ties 54 attached to it, and rear tie line 40 has three rear ties 56 attached to it. The front and rear ties 50, 52, 54, and 56 are each preferably between 10" and 12" long for ease of bow-tying. The ties may be of any suitable material, such as cloth, drawstring tie fabric, nylon, plastic, tape, or Velcro. Alternatively, there may be four ties instead of three ties spaced along each tie line. Also, instead of ties, metal, nylon or plastic snaps or buttons may be utilized as fasteners.

In order for comfortable sleeves to be formed, the first set of ties or uppermost ties 50, 52, 54, and 56 are preferably 10" from the shoulder line 13. The spacing for the remaining ties from the first set of ties range from 7" to 9" along the front and rear tie lines.

The sheet 10 is draped over the wearer to form a garment or gown, and because the front and back are identical, it does not matter which way it is draped. Further, it may be placed on the wearer or removed without utilizing the ties or unfastening the fastener elements (snaps, buttons, etc.).

Figure 6:
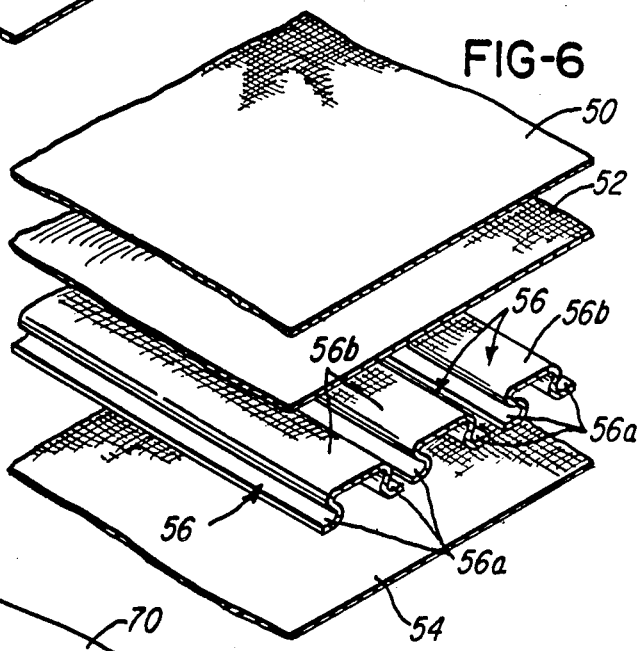
FIG. 6 is an end view of the tied garment.
Figure 8:
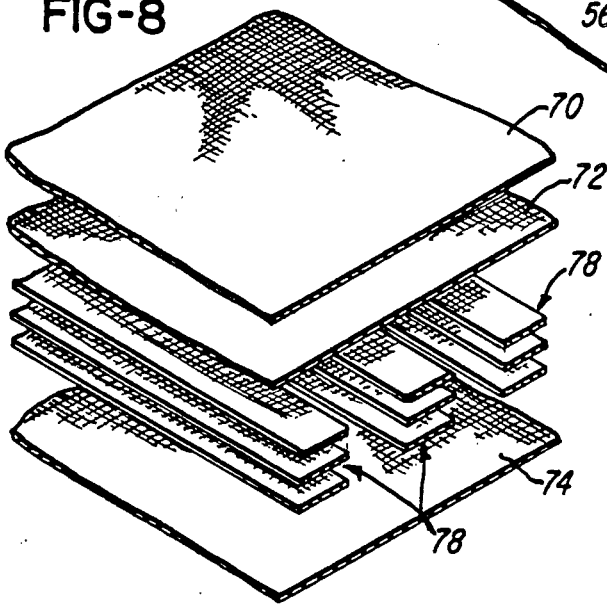
Figure 7:
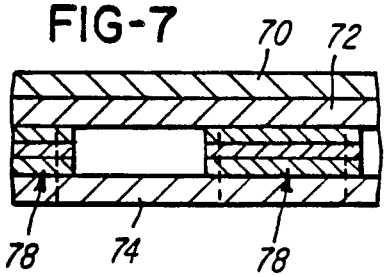
Figure 1:
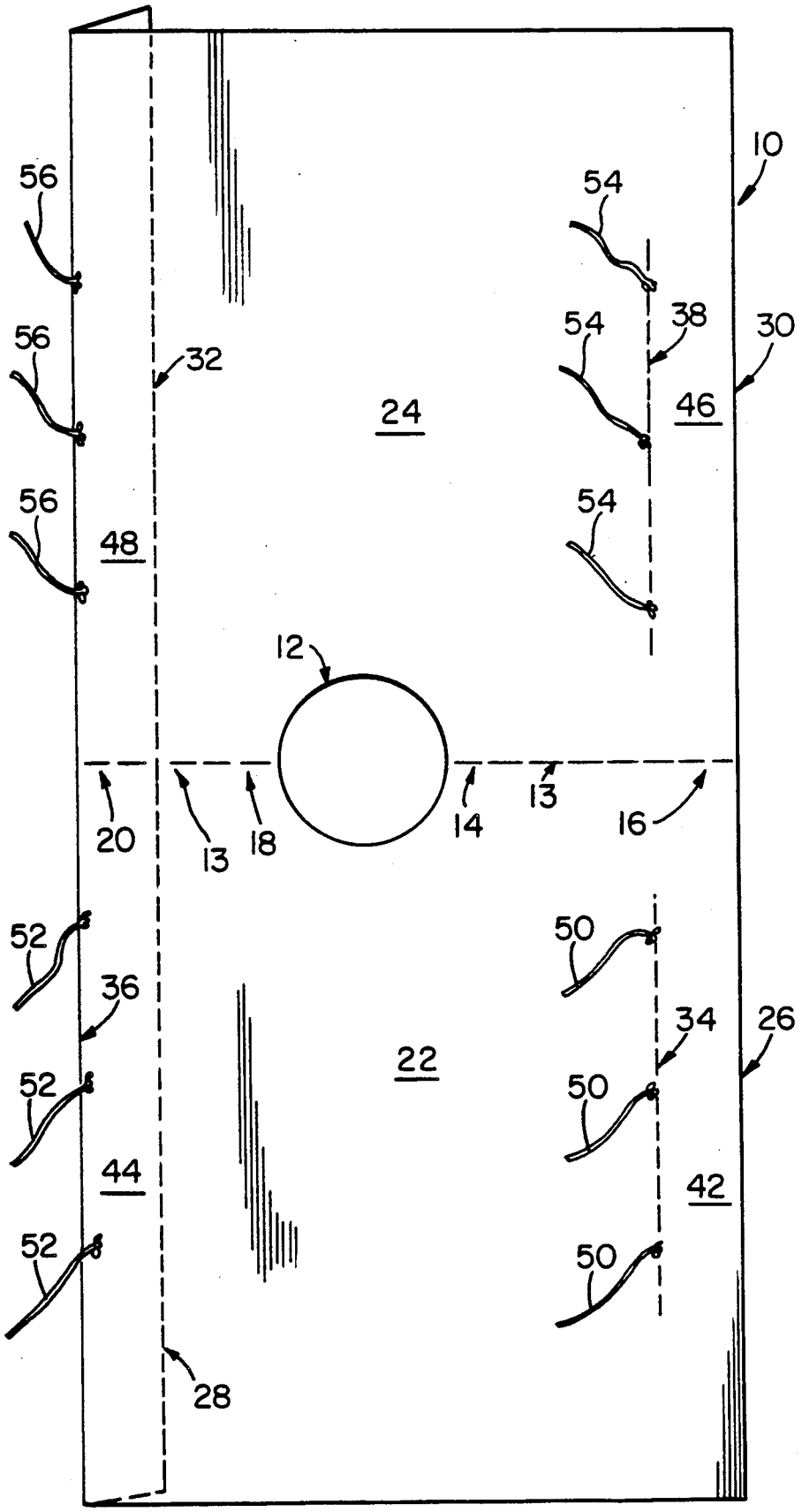
FIG. 1 is a plan view of the sheet in its open configuration.
Figure 1:
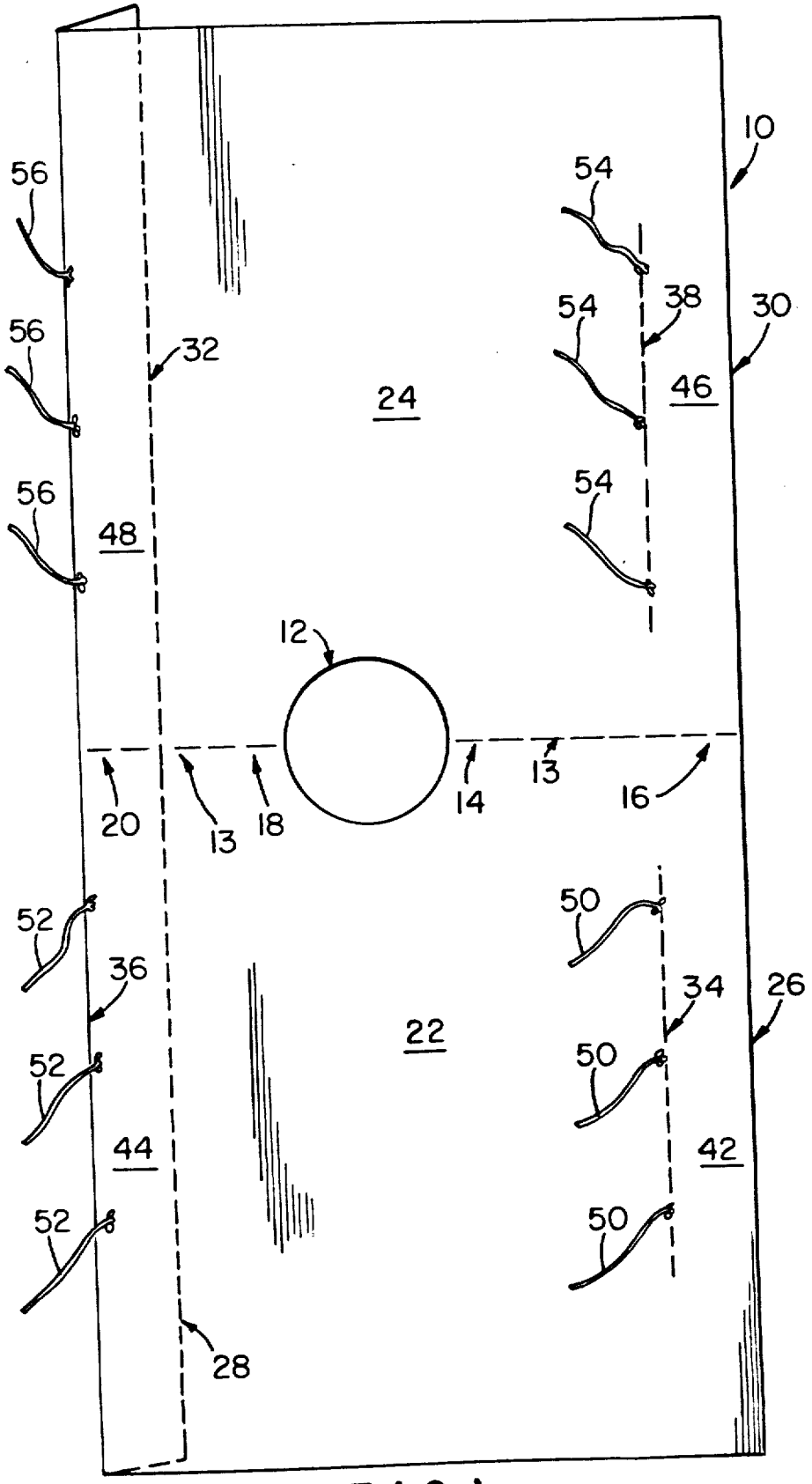
Figure 2:
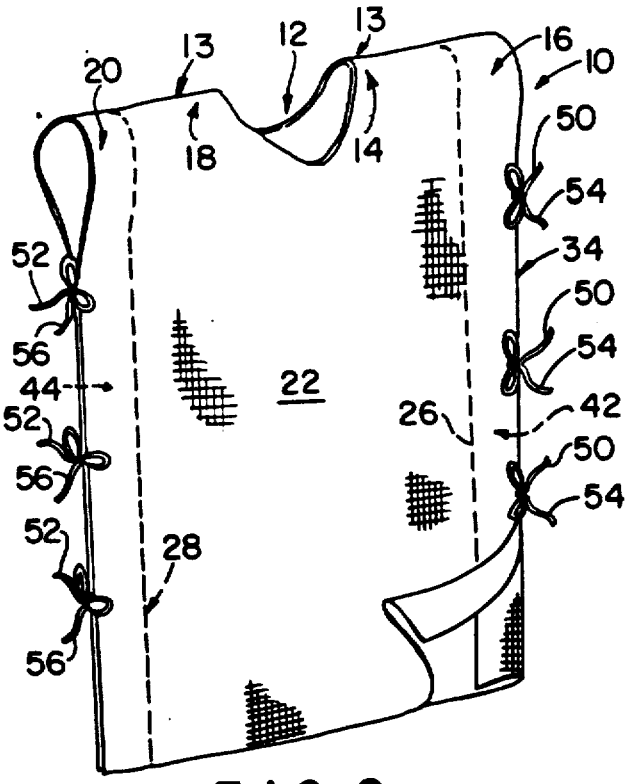
FIG. 2 is a perspective view of the sheet draped to form a garment.
Figure 3:
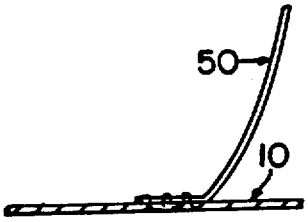
FIG. 3 illustrates the tie sewn to the sheet.
Figure 4:
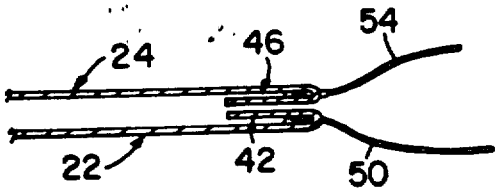
Figure 5:
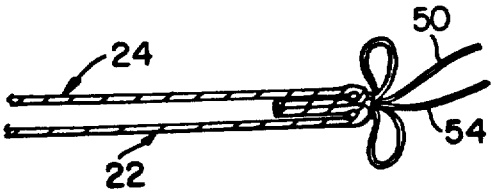
Figure 6:
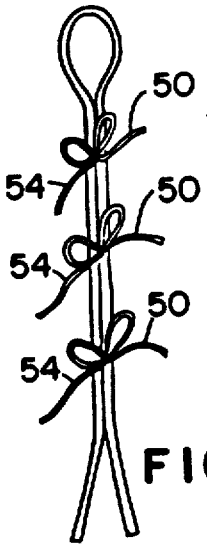

The front and rear fold sections 42, 44, 46, and 48 fold inwardly as the front ties on each side of the garment are tied to the corresponding rear ties on each side of the garment (as shown in FIG. 2) to close any openings between the ties for increased privacy of the wearer. (See FIG. 6.)

The gown can be untied or unfastened on either side, and the sleeves are formed by merely tying the uppermost set of front and rear ties, or by fastening the uppermost set of fastener elements. The gown, when made entirely of cloth and cloth ties, is appropriate for X-ray, C.T. scan, and radiation therapy procedures.

The gown can be opened anywhere along either side by unfastening one or more sets of ties or fastener elements. Thus, tubes, leads, lines for I.V. bottles, etc., may be connected to or removed from the patient without removing the gown and by simply untying appropriate ties. Also, the gown can be changed without removing leads or tubes from the patient by simply untying appropriate ties. Also, the side openings allow for examination and bedside care of the patient without removing the gown.

Advantageously, a patient wearing the gown of the present invention may stand, sit, or lie down without discomfort and without sacrificing privacy as in back-open, back-fastened gowns.

A latitude of modification, change, and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. A garment comprising:

(a) a single flat integral sheet of drapable material;

(b) said sheet being of elongated generally rectangular configuration;

(c) a central through opening for receiving a wearer's head;

(d) the sheet region on opposite sides of said opening defining shoulder sections and sleeve sections for covering said upper arms;

(e) the sheet region on opposite ends of said opening defining front and rear sections for covering respectively the front and back of a wearer;

(f) said sheet having first and second longitudinal edges;

(g) said sheet having first and second longitudinal tie lines remote from said first and second longitudinal edges, respectively, said area between said first longitudinal tie line and said first longitudinal edge defining a first fold section, and said area between said second longitudinal tie line and said second longitudinal edge defining a second fold section;

(h) two or more front fasteners attached to each of said first and second longitudinal tie lines in said front section;

(i) two or more rear fasteners attached to each of said first and second longitudinal tie lines in said back section;

(j) the front fasteners on each side of said front section are adapted to be fastened to the rear fasteners on each side of said rear section when the garment is draped over a wearer, whereby said first and second fold sections are folded inwardly to form two inwardly-extending adjoining flaps to close any openings between said fasteners for privacy of the wearer.

2. A garment in accordance with claim 1, wherein said first and second longitudinal tie lines are spaced inwardly approximately 2½" to 5" from said respective first and second longitudinal edges.

3. A garment in accordance with claim 1, wherein said front and rear fasteners are ties between 10" and 12" long for ease of bow tying.

4. A garment in accordance with claim 1, wherein said sheet is approximately 30" to 60" wide and 60" to 120" long.

5. A garment in accordance with claim 1, wherein said sheet has approximately a 2 to 1 length-to-width ratio.

6. A garment in accordance with claim 1, wherein said front and rear fasteners, when fastened, define said sleeves.

7. A garment in accordance with claim 1, wherein said sheet is formed of any reusable, drapable material.

8. A garment in accordance with claim 1, wherein said sheet is formed of a disposable material, such as paper, plastic, or Tyvex.

9. A garment in accordance with claim 3, wherein said ties are made of cloth, fabric, nylon, plastic, or any other suitable material.

10. A garment in accordance with claim 1, wherein there are three front fasteners on each side of the garment and three rear fasteners on each side of the garment.

11. A garment comprising:

(a) a single flat integral sheet of drapable material;

(b) said sheet being of elongated generally rectangular configuration;

(c) a central through opening for receiving a wearer's head;

(d) the sheet region on opposite sides of said opening defining shoulder sections and sleeve sections for covering said upper arms;

(e) the sheet region on opposite ends of said opening defining front and rear sections for covering respectively the front and back of a wearer;

(f) said sheet having first and second longitudinal edges;

(g) said sheet having first and second longitudinal tie lines remote from said first and second longitudinal edges, respectively, said area between said first longitudinal tie line and said first longitudinal edge defining a first fold section, and said area between said second longitudinal tie line and said second longitudinal edge defining a second fold section;

(h) two or more front fastener elements attached to each of said first and second longitudinal tie lines in said front section;

(i) two or more rear fastener elements attached to each of said first and second longitudinal tie lines in said back section;

(j) the front fastener elements on each side of said front section are adapted to be joined to the rear fastener elements on each side of said rear section when the garment is draped over a wearer, whereby said first and second fold sections are folded inwardly to form two inwardly-extending adjoining flaps to close any openings between said ties for privacy of the wearer.

12. A garment in accordance with claim 11, wherein said first and second longitudinal tie lines are spaced inwardly approximately 2½" to 5" from said respective first and second longitudinal edges.

13. A garment in accordance with claim 11, wherein said fastener elements are snaps, buttons, Velcro, adhesive-backed tape, or any other fastener element.

* * * * *

UNITED STATES PATENT AND TRADEMARK OFFICE

CERTIFICATE OF CORRECTION

PATENT NO. : 5,001,784

DATED : March 26, 1991

INVENTOR(S) : Charles J. Orlando, Jr.

It is certified that error appears in the above—identified patent and that said Letters Patent is hereby corrected as shown below:

Figs. (2 to 6) should be page 2 of 2 and sheet 2 Of 2 should be sheet 1 of 2 , as shown on the attached sheets.

Signed and Sealed this

First Day of September, 1992

*Attest:*

DOUGLAS B. COMER

*Attesting Officer*

*Acting Commissioner of Patents and Trademarks*